US007140832B2

(12) United States Patent
Jacks

(10) Patent No.: US 7,140,832 B2
(45) Date of Patent: Nov. 28, 2006

(54) METHOD AND SYSTEM FOR ROTATING A TURBINE STATOR RING

(75) Inventor: Curtis John Jacks, Greeneville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/907,504

(22) Filed: Apr. 4, 2005

(65) Prior Publication Data

US 2006/0222482 A1 Oct. 5, 2006

(51) Int. Cl.
*F01D 17/00* (2006.01)

(52) U.S. Cl. ..... 415/1; 415/127; 415/166

(58) Field of Classification Search ..... 415/1, 415/36, 42, 46, 48, 126, 127, 128, 159, 166, 415/191, 208.2, 211.2
See application file for complete search history.

(56) References Cited

U.S. PATENT DOCUMENTS

| | | | | |
|---|---|---|---|---|
| 779,949 | A * | 1/1905 | MacDonald | 415/159 |
| 4,785,624 | A * | 11/1988 | Smith et al. | 60/806 |
| 5,654,500 | A | 8/1997 | Herron et al. | 73/116 |
| 6,183,192 | B1 | 2/2001 | Tressler et al. | 415/115 |
| 6,341,238 | B1 * | 1/2002 | Modeen et al. | 700/66 |
| 6,554,562 | B1 * | 4/2003 | Dudebout et al. | 415/1 |
| 6,913,441 | B1 * | 7/2005 | Fadok | 415/189 |
| 2001/0010798 | A1 * | 8/2001 | Dailey et al. | 415/159 |

* cited by examiner

*Primary Examiner*—Edward K. Look
*Assistant Examiner*—Nathan Wiehe
(74) *Attorney, Agent, or Firm*—Cantor Colburn LLP

(57) ABSTRACT

A method for distributing effects of a circumferential hot streak condition in a turbine includes communicating a control signal to a rotator moving a stator ring with the rotator in response to the control signal.

20 Claims, 3 Drawing Sheets

METHOD AND SYSTEM FOR ROTATING A TURBINE STATOR RING

BACKGROUND OF THE INVENTION

The present invention relates to gas turbine engines, and, more specifically, to a stator of a gas turbine engine.

In a gas turbine engine, air is pressurized in a compressor and mixed with fuel and ignited in a combustor for generating combustion gases having high temperatures. Energy is extracted from the combustion gases in stages of a turbine. The turbine powers the compressor and produces useful work, such as driving a generator to produce power, for example.

Since turbines are continuously exposed to the combustion gases during operation, cooling of turbine components is required. Bleeding a portion of the pressurized air from the compressor and channeling it through the turbine components often provides cooling air to accomplish cooling of turbine components. However, the cooling air is at a premium with respect to overall turbine performance, since useful work has already been done to the cooling air in the compressor. Therefore, it is desirable for turbine performance that an amount of air bled for nozzle cooling be kept to a minimum.

A typical gas turbine directly receives combustion gases from the combustor and includes an initial stage stator and a corresponding initial stage rotor having a plurality of rotor blades or airfoils extending radially outward from a supporting disk. Nozzles disposed around a circumference of each stator stage direct a flow of the combustion gases toward a row of corresponding rotor blades. After the combustion gases pass through the initial stage stator and the initial stage rotor, subsequent stage stators then direct the combustion gases through a corresponding row of rotor blades extending from corresponding subsequent stage rotors. The subsequent stage stators receive lower temperature combustion gases than the initial stage stator and therefore have different cooling requirements. Additionally, individual nozzles within each of the initial and subsequent stator stages often receive combustion gases at different temperatures.

The nozzles of the turbine are designed for durability with extensive lives measured in hours and/or cycles of operation. Such extended life is difficult to achieve since the nozzles are subject to various differential temperatures during operation, which create thermal stresses on the nozzles. Additionally, nozzles are subjected to oxidation or erosion, which are temperature driven, and coating spallation (when applicable), which is driven by both temperature and thermal stress. Suitable nozzle cooling is required to limit thermal stresses and peak metal temperatures to ensure a useful life. However, temperature distributions and heat transfer coefficients of the combustion gases channeled through each nozzle vary significantly and increase the difficulty of providing suitable nozzle cooling.

Ensuring that suitable nozzle cooling is provided to each nozzle is a difficult problem. Turbines often experience localized areas of high temperature within a particular stage. Circumferential and radial variations in combustion exit temperatures create the localized areas of high temperature. An area having a highest temperature relative to surrounding areas is referred to as a hot-streak. Location of a hot streak and the dynamics thereof are not easily predictable, thus applying sufficient cooling to areas in the hot streak is problematic and potentially expensive since complex cooling systems are often required. Rotor blades are typically not significantly impacted by the presence of a circumferential hot streak since their exposure to temperatures associated with the hot streak is limited by rotation of the rotor blades. However, nozzles of a particular stator stage may be exposed to hot streak conditions for extended periods and endure high temperatures and thermal stresses, which shorten nozzle life.

Since hot streak conditions must be considered, nozzle design engineers typically design all nozzles to be able to withstand worst-case temperatures associated with exposure to hot streak conditions. Additionally, maintenance practices have been developed to inspect and replace nozzles after a certain number of running hours, or to extract nozzles and swap their locations in an effort to equalize accumulated part life consumption among the nozzles. Designing a worst-case nozzle capable of extended exposure to hot streak conditions requires additional expense and/or cooling flow requirements. Furthermore, maintenance practices requiring routine replacement or relocation of nozzles add to both expense and system down time, and the need for additional cooling flow diminishes turbine performance.

Accordingly, it is desired to develop a method and system for reducing the impact of hot streak conditions on turbine design to decrease cooling requirements for turbines, which may in turn decrease nozzle manufacturing expense, reduce turbine down time due to nozzle inspection or replacement, and enhance turbine performance.

BRIEF DESCRIPTION OF THE INVENTION

Exemplary embodiments of the invention include a method for distributing effects of a circumferential hot streak condition in a turbine. The method includes communicating a control signal to a rotator moving a stator ring with the rotator in response to the control signal.

Further exemplary embodiments of the invention include a turbine having a turbine stator stage rotatable in response to a control signal.

Another exemplary embodiment of the invention includes a system to move stator nozzles. The system includes a turbine and a rotator. The turbine includes a turbine stator stage rotatable in response to a control signal. The rotator is in operable communication with the stator stage and configured to rotate the stator stage in response to the control signal.

The above, and other objects, features and advantages of the present invention will become apparent from the following description read in conjunction with the accompanying drawings, in which like reference numerals designate the same elements.

BRIEF DESCRIPTION OF THE DRAWINGS

Referring now to the drawings wherein like elements are numbered alike in the several FIGURES.

DETAILED DESCRIPTION OF THE INVENTION

Figure 1:
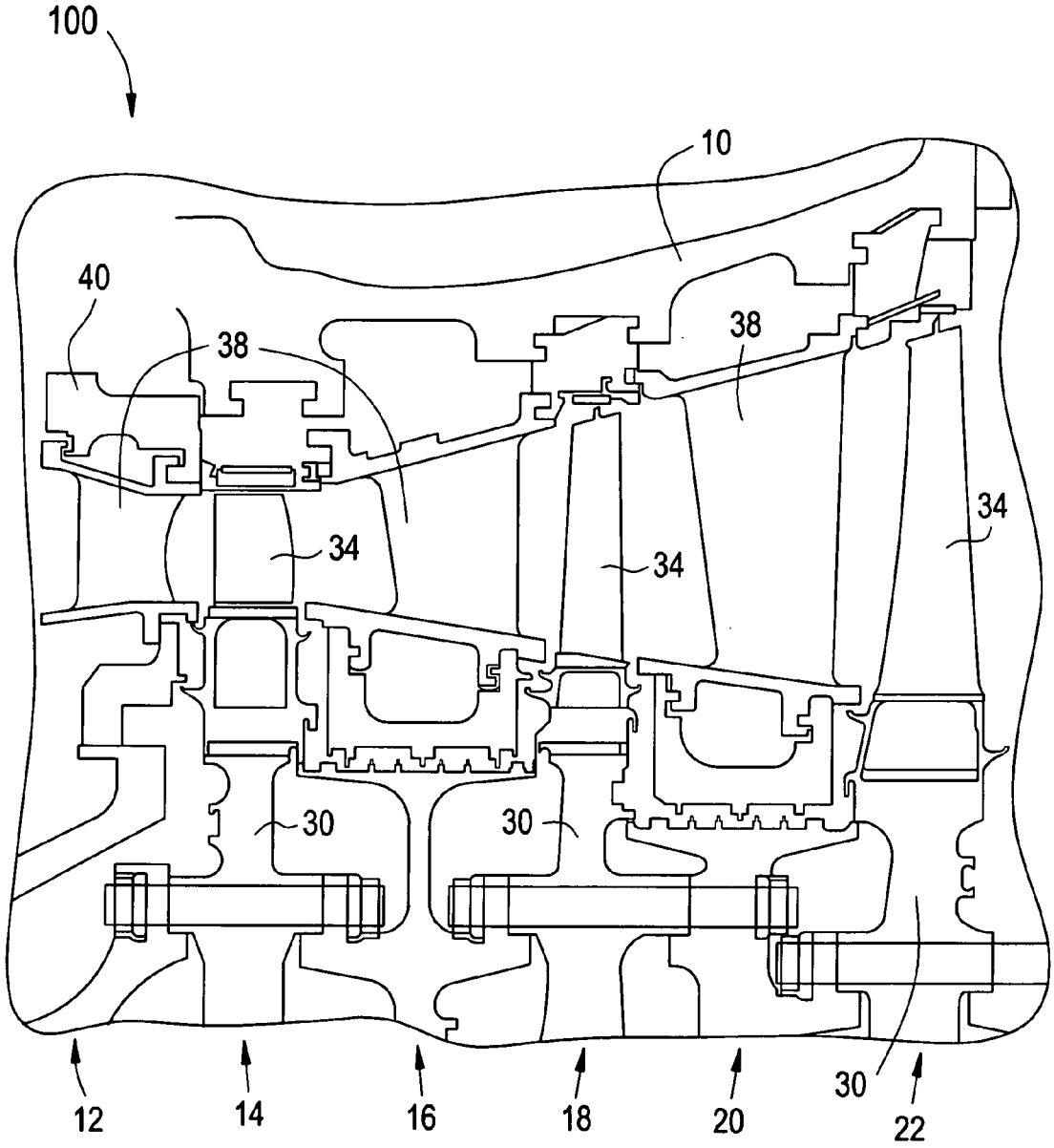
FIG. 1 is a sectional view of a turbine taken along a longitudinal axis of the turbine according to an exemplary embodiment.
Figure 2:
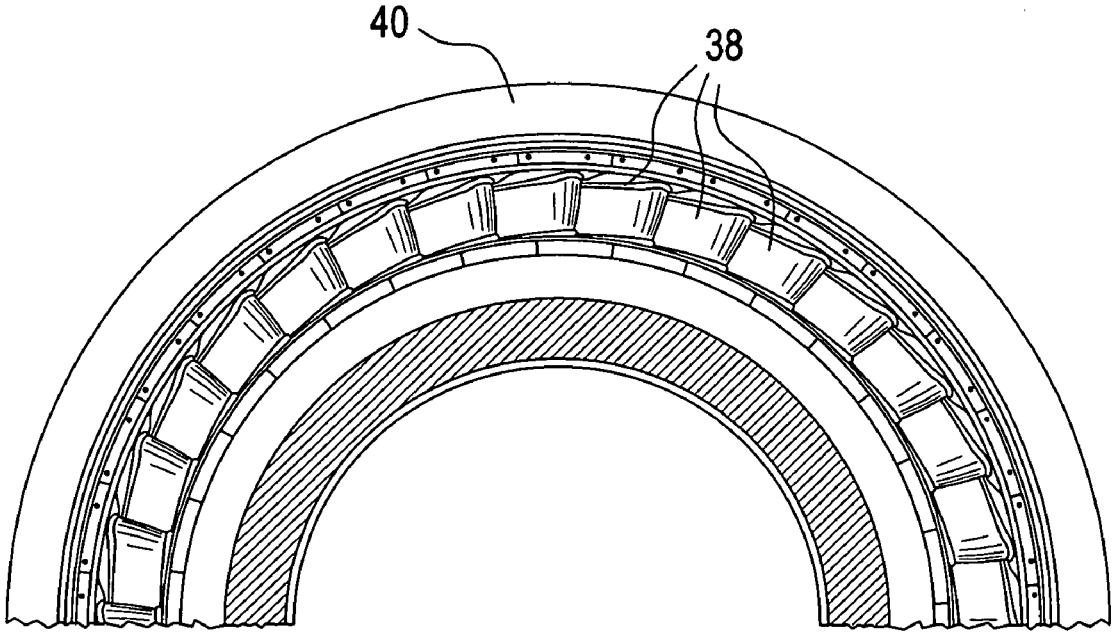
FIG. 2 is a portion of a section cut of a turbine taken along a radial axis showing a perspective view of a turbine stator stage according to an exemplary embodiment.

FIG. 1 is a sectional view of a turbine taken along a longitudinal axis of the turbine according to an exemplary embodiment. FIG. 2 is a portion of a section cut of a turbine taken along a radial axis showing a perspective view of a turbine stator stage according to an exemplary embodiment. Referring to FIGS. 1 and 2, the turbine 100 includes a turbine casing 10, a first stage stator 12, a first stage rotor 14, a second stage stator 16, a second stage rotor 18, a third stage stator 20 and a third stage rotor 22. Stator and rotor stages 12 through 22 are alternately arranged within the turbine casing 10, such that each of the first, second and third stage stators 12, 16 and 20 is disposed proximate to a corresponding one of the first, second and third stage rotors 14, 18 and 22, respectively. Although the turbine 100 of this exemplary embodiment includes three stages of both stator and rotor, it should be noted that any number of stages may be used in employing the principles discussed hereafter.

Each one of the first, second and third stage rotors 14, 18 and 22 includes a supporting disk 30 mounted on a shaft (not shown) and rotor airfoils 34. The rotor airfoils 34 are mechanically connected to the supporting disk 30, such that the supporting disk 30 may rotate with the shaft in response to a force from combustion gases or another working fluid passing over the rotor airfoils 34. Rotation of the shaft may then be translated as an output to power a compressor (not shown) and produce useful work, for example, in an engine or generator.

In an exemplary embodiment, each one of the first, second and third stage stators 12, 16 and 20 includes stator airfoils or nozzles 38 and a stator ring 40. The nozzles 38 of each one of the first, second and third stage stators 12, 16 and 20 are mechanically connected to a corresponding stator ring 40. The nozzles 38 of the first, second and third stage stators 12, 16 and 20 are disposed proximate to the corresponding rotor airfoils 34 of the first, second and third stage rotors 14, 18 and 22, respectively. Thus, the nozzles 38, which are substantially static from a perspective of each one of the first, second and third stage rotors 14, 18 and 22, direct a flow of the combustion gases over corresponding rotor airfoils 34. In an exemplary embodiment, each one of the first, second and third stage stators 12, 16 and 20 is non-responsive to the force from combustion gases or another working fluid.

Figure 3:
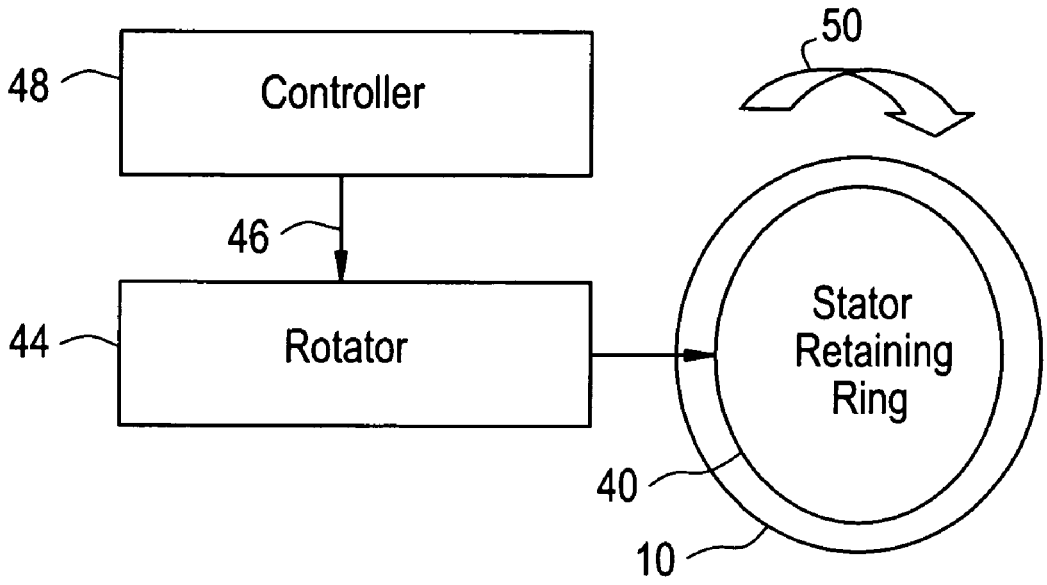
FIG. 3 is a block diagram illustrating a system for rotating a turbine stator ring according to an exemplary embodiment.

FIG. 3 is a block diagram illustrating a system for rotating the stator ring 40 according to an exemplary embodiment. Referring now to FIGS. 1–3, in this exemplary embodiment, the stator ring 40 is rotatably mounted within the turbine casing 10. A rotator 44 is in operable communication with the stator ring 40. The rotator 44 may be in operable communication with more than one stator ring 40. The rotator 44 is an apparatus configured to cause a rotation of the stator ring 40 in response to a control signal 46 from a controller 48. In an exemplary embodiment, the stator ring 40, although rotatable, is configured to rotate slowly about a longitudinal axis of the turbine 100 to ensure that the nozzles 38 appear substantially static from the perspective of each one of the first, second and third stage rotors 14, 18 and 22. Although any aerodynamically feasible rotation speed of the stator ring 40 is possible, in another exemplary embodiment, the stator ring 40 rotates at a speed of less than about one revolution per minute (RPM). The stator ring 40 rotates, for example, in a direction shown by arrow 50, though any direction of rotation is possible.

In an exemplary embodiment, the rotator 44 includes any of a number of suitable means to provide a force to rotate the stator ring 40. Examples of a suitable rotator 44 include, but are not limited to, an electric motor, a ratchet assembly, and a combustion engine. The rotator 44 may be disposed at the turbine 100 or disposed remote from the turbine 100 and in operable communication with the turbine 100 via, for example, a series of shafts and gears, belts, etc. Furthermore, the rotator 44 may derive power from an output of the turbine 100 via a drive assembly having, for example, a series of shafts and reduction gears, etc. The rotator 44 provides the force to rotate the stator ring 40 in response to the control signal 46 from the controller 48. In another exemplary embodiment, the stator ring 40 may be rotated by a force from a working fluid, for example, a combustion gas, and the rotator 44, responsive to either an active or passive control signal 46, provides a resistive force to slow rotation of the stator ring 40. Additionally, it should be noted that although FIG. 1 shows only the first stage stator 12 as having the stator ring 40, the stator ring 40 is disposed at each stator stage for which rotation is desired.

The controller 48 provides the control signal 46 to actuate the rotator 44 and thereby rotate the stator ring 40. The controller 48 includes any of many suitable means to provide the control signal 46 to the rotator 44. Examples of a suitable controller 48 include, but are not limited to, a timer, a delay, a logic circuit, a speed regulator and an external actuator that may be controlled by an operator, such as a switch. In an exemplary embodiment, a timer is employed to index or rotate the stator ring 40 at a selected time interval via an electric motor. In another exemplary embodiment, a ratchet assembly indexes the stator ring 40 controlled by a delay between ratchet operations. In another exemplary embodiment, a logic circuit directs an electric motor to index the stator ring 40 in response to selected criteria. In another exemplary embodiment, the stator ring 40 is rotated at a constant differential speed with respect to a speed of a rotor stage via an electric motor controlled by a speed regulator. In yet another exemplary embodiment, an operator actuates a switch to engage a series of shafts and gears to rotate the stator ring 40. Other examples, although not listed herein, are also envisioned.

The control signal 46 may be communicated to the rotator 44, for example, by an electrical, mechanical, optical or fluid means of transmission. The control signal 46 is either a continuously applied signal, such as, for example, an enablement to continuously rotate a ratchet on a delay, or a discretely applied signal, such as, for example, a spring loaded switch having a rotate and a non-rotate position. The control signal 46 may be active or passive.

Figure 4:
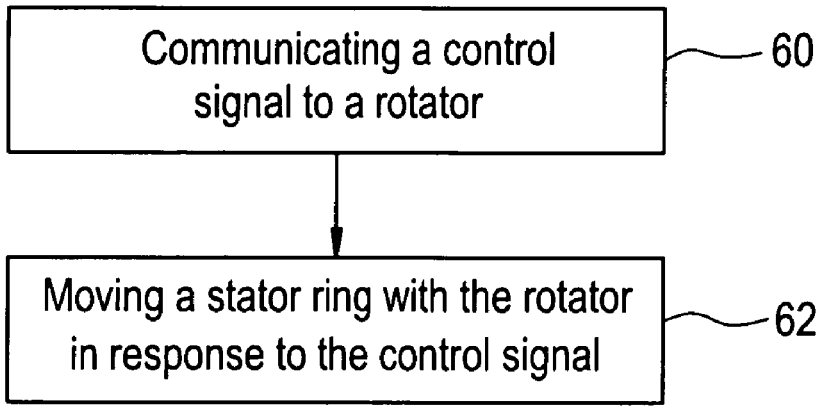
FIG. 4 is a block diagram illustrating a method for rotating a turbine stator ring according to an exemplary embodiment.

FIG. 4 is a block diagram illustrating a method for distributing effects of a circumferential hot streak condition in a turbine according to an exemplary embodiment. The method includes communicating a control signal to a rotator at block 60 and moving a stator ring with the rotator in response to the control signal at block 62.

By rotating the stator ring 40, the effects of a circumferential hot streak are distributed evenly among the nozzles 38. Thus, design considerations for the nozzles 38 do not require a designer to design an expensive nozzle capable of withstanding circumferential hot streak conditions. Additionally, cooling requirements may be decreased or simplified resulting in cost savings and/or enhanced turbine performance. Furthermore, complicated and time consuming maintenance practices aimed at evenly distributing circumferential hot streak effects among the nozzles 38 may also be avoided.

It is envisioned that the rotator 44 is capable of operable communication with one or more stator rings 40. Alternatively, a number of rotators 44 may be less than or equal to a number of stator rings 40. Since circumferential hot streak conditions are experienced to a greater degree by turbine components disposed closest to an output of the combustor, and cooling requirements are generally decreased as distance from the combustor is increased, it may be desired to rotate the stator ring 40 of only those stator stages that are disposed closest to the output of the combustor, as shown in FIG. 1. Furthermore, in an exemplary embodiment the controller 48 is configured to apply the control signal 46 to the rotator 44 only during periods that the turbine 100 is off-line. In an alternative exemplary embodiment, the controller 48 is configured to apply the control signal 46 to the rotator 44 during periods that the turbine 100 is on-line.

In addition, while the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method for distributing effects of a circumferential hot streak condition in a turbine, the method comprising:

communicating a control signal to a rotator;

moving a stator ring including stator nozzles with the rotator in response to the control signal; and distributing the circumferential hot streaks among a substantial number of said stator nozzles of said stator ring during operation of the turbine.

2. The method of claim 1, wherein the moving the stator ring comprises one of:

transmitting a rotational force to the stator ring via the rotator; and resisting a rotational force on the stator ring via the rotator, the rotational force being communicated to the stator ring by a working fluid.

3. The method of claim 1, wherein the moving the stator ring comprises rotating the stator ring about a longitudinal axis of the turbine.

4. The method of claim 1, further comprising producing the control signal at a controller.

5. The method of claim 4, wherein the producing the control signal at the controller comprises at least one of:

producing a continuous control signal; and producing a discrete control signal.

6. A turbine comprising:

a stator stage including stator nozzles, said stage being rotatable to distribute a circumferential hot streaks among a substantial number of said nozzles during operation of the turbine and in response to a control signal.

7. The turbine of claim 6, further comprising a rotor stage disposed proximate to the stator stage and rotatable in response to a flow of the working fluid, wherein the stator stage is rotatable at a selected differential speed with respect to a speed of rotation of the rotor stage.

8. The turbine of claim 6, wherein the stator stage is configured to rotate continuously.

9. The turbine of claim 8, wherein the stator stage rotates continuously at a speed of less than about one revolution per minute.

10. The turbine of claim 6, wherein the stator stage is rotatable at discrete intervals.

11. A system to move stator nozzles comprising:

a turbine comprising:

a stator stage including stator nozzles, said stage being rotatable to distribute a circumferential hot streaks among a substantial number of said nozzles during operation of the turbine and in response to a control signal; and a rotator in operable communication with the stator stage and configured to rotate the stator stage in response to the control signal.

12. The system of claim 11, wherein the control signal is applied to the rotator at one of continuously and at discrete intervals.

13. The system of claim 11, wherein the stator stage rotates continuously at a speed of less than about one revolution per minute.

14. The system of claim 11, further comprising a rotor stage disposed proximate to the stator stage and rotatable in response to a flow of the working fluid, wherein the stator stage is rotatable at a selected differential speed with respect to a speed of rotation of the rotor stage.

15. The system of claim 11, wherein the control signal comprises at least one of:

an electrical signal;

a mechanical signal;

a fluid signal; and an optical signal.

16. The system of claim 11, wherein the rotator comprises at least one of:

an electric motor;

a ratchet;

a combustion engine; and a drive assembly.

17. The system of claim 11, further comprising a controller in communication with the rotator and configured to provide the control signal to the rotator.

18. The system of claim 17, wherein the controller comprises at least one of:

a delay;

a timer;

a speed regulator;

a logic circuit;

an external actuator; and a switch.

19. The system of claim 11, wherein the control signal is applied during one of turbine off-line periods and turbine on-line periods.

20. The system of claim 11, wherein the stator stage comprises:

a stator ring rotatably disposed at the turbine, the stator ring having the stator nozzles attached thereto.

* * * * *